US005588830A

United States Patent [19]

Josefsson et al.

[11] Patent Number: 5,588,830

[45] Date of Patent: Dec. 31, 1996

[54] COMBINED RADIANT AND CONVECTION HEATING OVEN

[75] Inventors: Leif E. B. Josefsson, Lake Orion; Robert F. Monte, Fair Haven, both of Mich.

[73] Assignee: ABB Paint Finishing, Inc., Auburn Hills, Mich.

[21] Appl. No.: 372,595

[22] Filed: Jan. 13, 1995

[51] Int. Cl.[6] ..... F27B 9/00

[52] U.S. Cl. ..... 432/147; 432/121; 432/143; 432/146; 432/209; 34/476

[58] Field of Search ..... 432/120, 121, 432/136, 143, 146, 147, 148, 209; 34/30

[56] References Cited

U.S. PATENT DOCUMENTS

| | | |
|---|---|---|
| 2,391,195 | 12/1945 | Ross et al. . |
| 2,472,293 | 6/1949 | Groven . |
| 4,416,068 | 11/1983 | Nilsson et al. . |
| 4,635,381 | 1/1987 | Hubbert . |
| 4,761,894 | 8/1988 | Hamasaki . |
| 4,771,728 | 9/1988 | Bergman, Jr. et al. . |
| 4,785,552 | 11/1988 | Best . |
| 5,230,161 | 7/1993 | Best . |
| 5,263,265 | 11/1993 | Melgaard . |

FOREIGN PATENT DOCUMENTS

| | | |
|---|---|---|
| 0142071A3 | 10/1984 | European Pat. Off. . |
| 4324488A1 | 1/1995 | Germany . |
| 813101 | 5/1959 | United Kingdom . |
| WO87/01186 | 2/1987 | WIPO . |

OTHER PUBLICATIONS

PCT International Search Report (6 pages), dated May 29, 1996.

*Primary Examiner*—Henry A. Bennett
*Assistant Examiner*—Siddh Arth Ohri
*Attorney, Agent, or Firm*—Harness, Dickey & Pierce, P.L.C.

[57] ABSTRACT

A combined radiant and convection oven controls the rate at which heat is transferred to an object being dried within the oven by varying the flow rate of convection air delivered to the oven's heating chamber. The radiating surfaces within the oven are heated by a novel arrangement of longitudinally extending ducts, each duct associated independently with a different radiating surface.

35 Claims, 4 Drawing Sheets

351
PLC
VFD
352
320
300
327b
306
327a
353b
322
311
379a
328b
335
328a
338
301
392a
350
391a
314
390e
377a
301
305
379b
390a
391b
392b
390f
377b
303
390b
391c
392c
377c
392d
391d
390g
377d
379c
390h
379d
321
129b
361a
129a
390c
301
390d
361b
331
375
376
373
372
355
382
381
PLC
354
340
374
310
315
307
M
312
316
371
308
366
309
370
365
317
M
383b
M
383c
367
383
383a

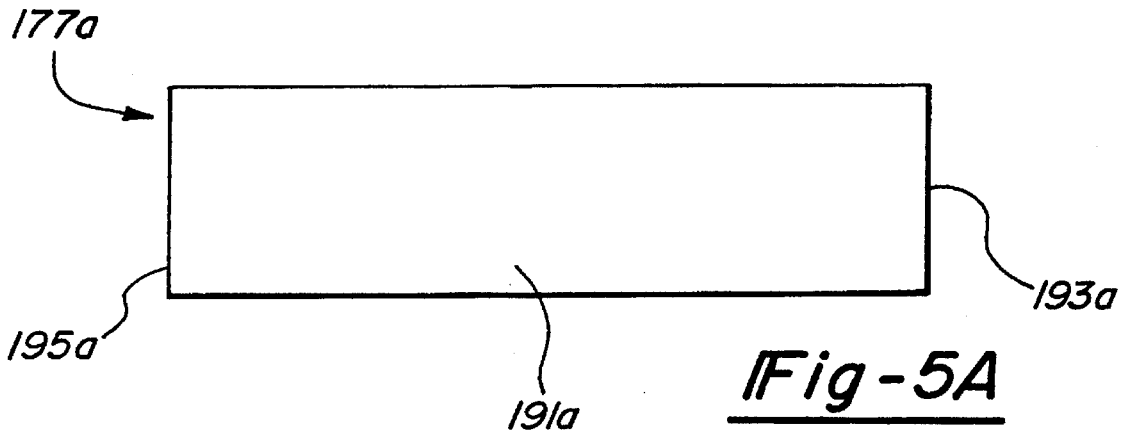
Fig-5A
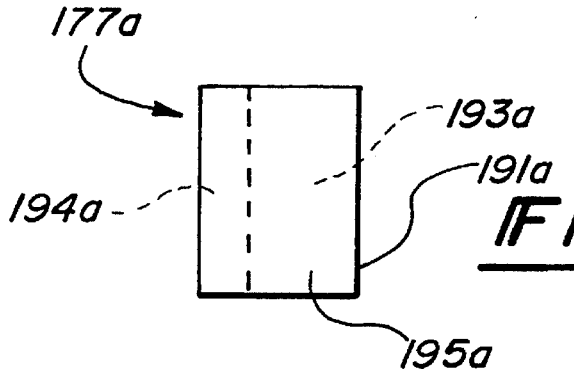
Fig-5B
Fig-5C
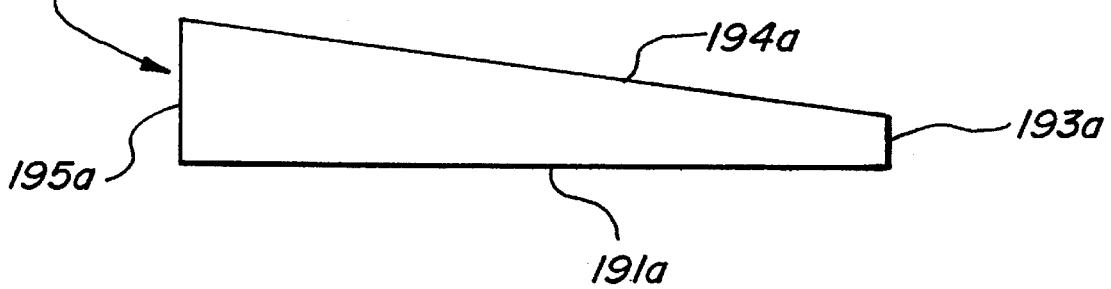

COMBINED RADIANT AND CONVECTION HEATING OVEN

BACKGROUND OF THE INVENTION

The invention relates generally to a heating oven for drying and curing objects therein. More particularly, the invention concerns a combined radiant and convection heating oven for such applications as drying of painted objects.

It is known in the paint finishing art to dry and cure paint coatings on objects, such as automobile body parts, by subjecting the objects to both convection zones and radiation heat zones in a paint baking oven. Furthermore, it has been previously suggested that the benefits of convection and radiant heating may be advantageously combined in the same area of an oven. For example, see *Radiant Convection Heating, A Marriage Of Two Systems,* by Henry J. Bennett, *Industrial Gas,* February 1976. The Bennett reference suggests the combination of convection heating and infra-red radiant heating to combine the benefits of both and to cancel out the drawbacks of each in a combination called "radiant-convection heating". In such a combination, Bennett suggested that the benefits of convection heating (uniformity of temperature profile over the surface of the object being baked) and infra-red radiant heating (speed) may be used to cancel out each other's drawbacks when used in combination.

U.S. Pat. No. 4,785,552 to Best discloses a convection stabilized radiant oven wherein the ambient temperature of the oven air and the temperature of the radiant walls in the oven chamber are both controlled. The '552 patent discloses a baffle plate arrangement in one embodiment and turbulating fans in another in a combustion chamber immediately behind the radiant emitter walls of the oven for supplying heat to the radiation emitting surfaces.

U.S. Pat. No. 5,230,161 to Best discloses a radiant wall structure for use in a paint baking oven with a combustion chamber abutting the radiant wall and having a cross-sectional area or distance between the walls of the combustion chamber varying as one proceeds from the bottom of the oven to the top thereof.

Prior art radiant ovens are additionally known which feature longitudinally extending radiant heating ducts abutting the radiant surfaces, but the ducts are not truly independently controllable, in that they are conventionally interconnected in serpentine fashion thereby providing, as does the Best '552 and '161 patents, unitary heating chambers behind the radiant surfaces.

There is therefore seen to be a need for a combined radiant and convection heating oven wherein the temperature of the object being baked may be controlled by holding the ambient air temperature in the oven substantially constant while varying the convective heat transfer coefficient—i.e. the rate at which heat is transferred from the convection air to the surface of the object—by varying the air flow volume of the convection air impinging upon the object being dried. There is also seen to be a need for controlling the temperature profile of the radiant surfaces in such an oven by providing for a plurality of independent radiation panels, each panel having its own heating duct which can be independently regulated to a predetermined temperature. Finally, there is seen to be a need for a combined radiant and convection oven wherein the radiating surfaces may establish a predetermined temperature profile over a longitudinal length of the oven as well as the height of the baking chamber thereof by, for example, varying the cross-sectional area of the heating ducts associated with such radiation panel to vary the air flow rate or other heating gas flow rate therethrough.

SUMMARY OF THE INVENTION

Accordingly, a combined radiant and convection heating oven for uniformly heating an object over its surface includes a heating chamber extending along a longitudinal axis of the oven, at least one motor-driven fan having an output in fluid communication with the heating chamber for delivering a convection gas, such as air, to the chamber, and having an input for receiving the convection gas returning from the chamber. Additionally, the oven provides at least one radiant heat emitting surface extending substantially parallel to the longitudinal axis and positioned within the heating chamber. A duct carrying a heated gas, such as air, abuts the radiant heat emitting surface for transferring heat thereto. A suitable source of the heating gas has an output coupled to each duct. A temperature sensor is positioned to monitor temperature of the convection gas returning from the heating chamber, and suitable control elements coupled to the temperature sensor are provided for varying a rate at which heat is transferred from the convection gas and the radiant heat emitting surfaces to the object while maintaining the ambient air temperature within the oven chamber at a predetermined set point.

In another aspect of the invention, a heating oven comprises a heating tunnel having a top surface and a bottom surface extending along a longitudinal axis of the oven. A plurality of heated gas carrying ducts each carry or integrally incorporate a radiant heat emitting surface heated by its respective duct, each duct extending longitudinally along and within the tunnel such that at least two adjacent, separate radiant heat emitting surfaces are positioned between the top surface and the bottom surface of the tunnel, each duct having a cross-section taken substantially normal to the longitudinal axis which varies in area at different locations in each duct along the axis.

In yet another aspect of the invention, a heating oven comprises a heating tunnel having a top surface and a bottom surface extending along a longitudinal axis of the oven. A plurality of heated gas carrying ducts each carry or integrally incorporate a radiant heat emitting surface heated by its respective duct, each duct extending longitudinally along and within the tunnel, such that at least two adjacent, separate radiant heat emitting surfaces are positioned between the top surface and the bottom surface of the tunnel, each duct having adjustable dampers for independently controlling the flow rate of heated gas through each duct.

BRIEF DESCRIPTION OF THE DRAWING

The objects and features of the invention will become apparent from a reading of a detailed description of preferred embodiments thereof, taken in conjunction with the drawing, in which:

FIGS. 5A, 5B and 5C present front, end and top plan views, respectively, of one of the radiant surface heating ducts of the oven of FIG. 1 having a variable cross sectional area as viewed along a longitudinal axis of the duct.

DETAILED DESCRIPTION

Figure 1:
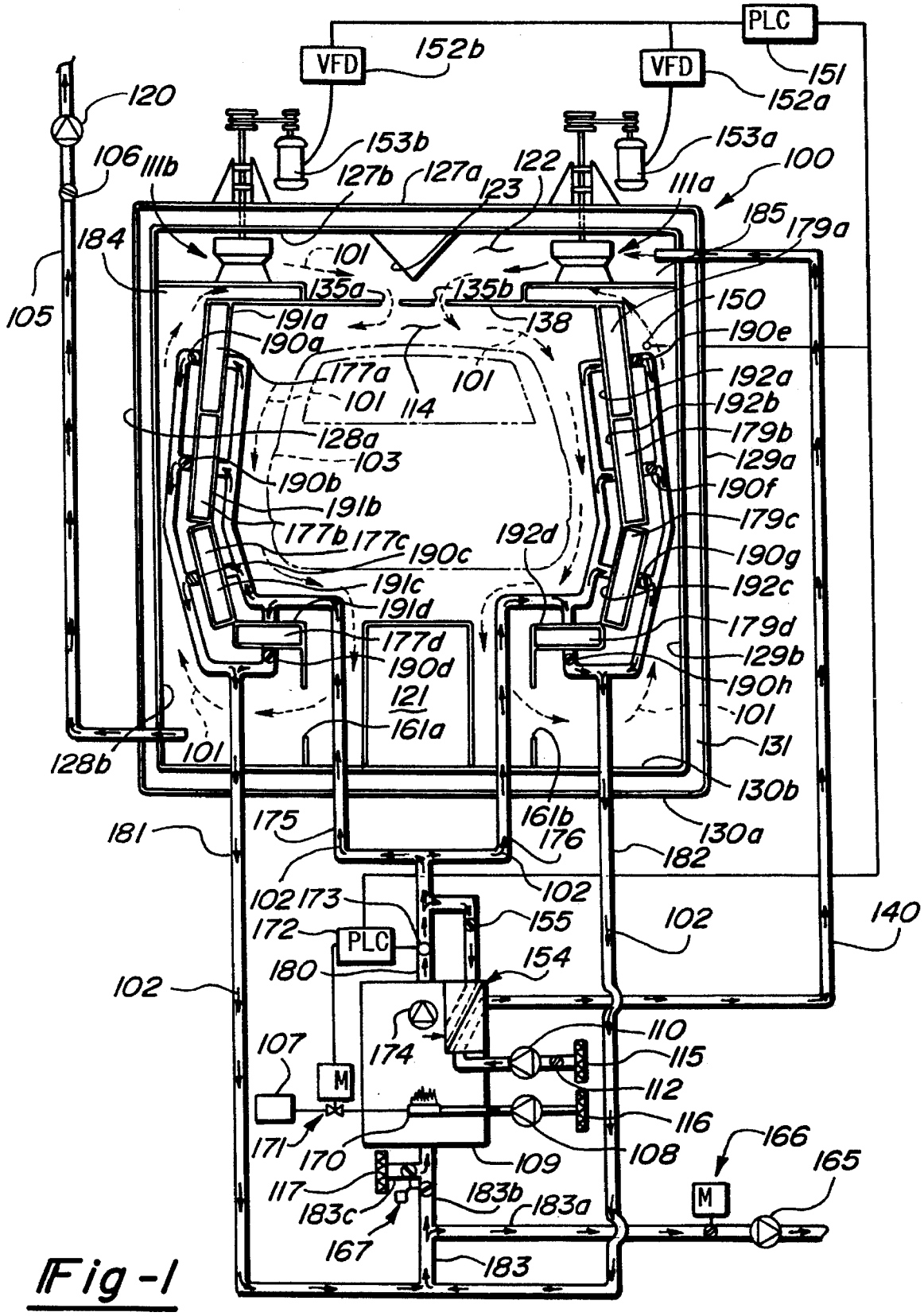
FIG. 1 is a cross-sectional view taken along a longitudinal axis of a combined radiant and convection oven arranged in accordance with the principles of the invention.
Figure 2:
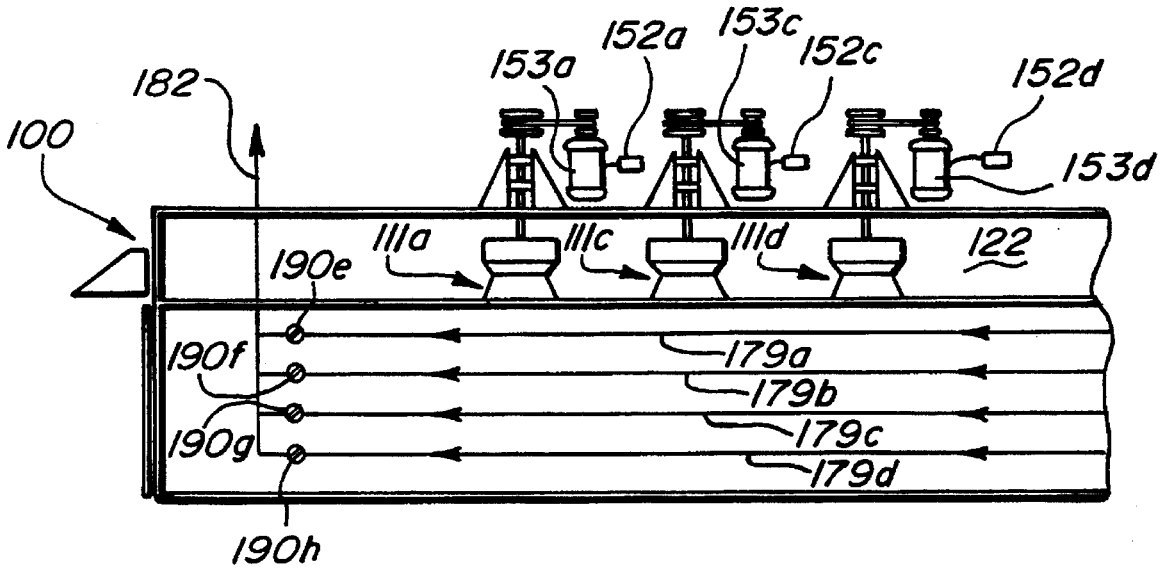
FIG. 2 is a partial cross-sectional view of the oven of FIG. 1 taken perpendicularly to the oven's longitudinal axis.

With reference to FIGS. 1 and 2, paint baking oven 100 extends along a longitudinal axis into and out of the page bearing the cross-sectional view of oven 100 as set forth in FIG. 1. Oven 100 is bounded by an oven outer roof 127*a*, and oven outer floor 130*a*, which are interconnected by vertically extending oven outer side walls 128*a* and 129*a*. An annular gap for holding material such as appropriate insulating medium 131 is formed in conjunction with the outer surfaces of the oven by inner-oven ceiling 127*b*, oven inner floor 130*b*, and inner side walls 128*b* and 129*b*.

Mounted to the oven roof are a plurality of centrifugal fan assemblies 111 arranged in pairs spaced longitudinally along the oven's length. Two such fan assemblies 111*a* and 111*b* are shown in the cross-sectional view of FIG. 1, while one half of three longitudinally arranged pairs of fan assemblies are shown in the longitudinal cross-section of FIG. 2 (111*a*, 111*c*, 111*d*). The drive shaft of each fan assembly 111 is suitable interconnected by a drive belt to a drive motor 153. Two such drive motors 153*a* and 153*b* are shown in FIG. 1, while one half of three pairs of drive motors are shown in the longitudinal view of FIG. 2 (153*a*, 153*c*, 153*d*).

A convection air supply plenum 122 extends longitudinally along the upper portion of oven 100 and is bounded by oven inner roof 127*b* and ceiling 138 of oven drying chamber 114. Extending longitudinally in plenum 122 is a air flow director or splitter 123 having substantially triangular cross-section as shown in FIG. 1 for directing the convection air output by fan assemblies 111*a* and 111*b* downwardly through longitudinally extending slots 135*a* and 135*b* in ceiling 138.

Objects, such as automobile bodies 103, to be baked in oven 100 are suitably positioned and transported longitudinally through the oven's drying chamber 114 by a conveyor system 121 shown positioned centrally of the oven along the inner floor 130*b* thereof.

Drying chamber 114 is further bounded on either side by first and second pluralities of longitudinally extending radiant energy emitting surfaces 191 and 192. As seen from FIG. 1, the surfaces at the left side of the chamber 114 are designated 191*a*, 191*b*, 191*c*, and 191*d*, while those on the right hand side of the cross-sectional view are designated 192*a*, 192*b*, 192*c*, and 192*d*. Each radiant energy emitting surface 191*a–d* and 192*a–d* is carried by or is an integral part of a longitudinally extending duct carrying a suitable heating gas, such as air. Surfaces 191*a–d* are respectively associated with ducts 177*a*, 177*b*, 177*c* and 177*d*, while radiant emitting surfaces 192*a–d* are associated with respective ducts 179*a*, 179*b*, 179*c* and 179*d*.

One or more of the ducts 177 and 179 may have a cross-sectional area as viewed from FIG. 1 which extends substantially normal or perpendicular to a longitudinal axis of the oven, which area varies as one proceeds along the longitudinal axis of the oven (i.e. into or out of the page bearing FIG. 1). The varying cross sectional area will be discussed in a later section of this description in conjunction with FIGS. 5A, 5B and 5C.

Located between ducts 177*a–d* and oven inner side wall 128*b* is a return air plenum 184 which fluidly communicates with drying chamber 114 via longitudinally extending opening 161*a*. Plenum 184 is likewise in fluid communication with an input to fan assembly 111*b*. In a similar fashion, return air plenum 185 is located between ducts 179*a–d* and oven inner side wall 129*d*. Plenum 185 is in fluid communication for receipt of convection air returning from chamber 114 via longitudinally extending opening 161*b*. Plenum 185 additionally is in fluid communication with an input to fan assembly 111*a*.

A selected portion of the convection gas (e.g. air) exiting oven drying chamber 114 may be exhausted to a suitable exterior treatment facility via exhaust duct 105, adjustable exhaust control damper 106 and exhaust fan 120.

Heated gas, such as air, is supplied to ducts 177*a–d* and 179*a–d* by furnace assembly 109 from an output duct 180 thereof which branches into input ducts 175 and 176. Duct 175 extends to a manifold arrangement providing inputs to ducts 177*a–d* at a first longitudinal end of the ducts 177*a–d*. Duct 176 leads to a manifold arrangement providing inputs to each of ducts 179*a–d* also at one longitudinal end thereof.

The heating gas is returned from ducts 177*a–d* and 179*a–d* via return ducts 181 and 182 which extend from output manifold arrangements at opposite longitudinal ends of ducts 177*a–d* and 179*a–d*, each output of the ducts being equipped with a manually or automatically controlled damper assembly 190*a*, 190*b*, 190*c* and 190*d* for ducts 177*a–d*, respectively, and damper assemblies 190*e*, 190*f*, 190*g*, and 190*h* for ducts 179*a–d*, respectively.

Return ducts 181 and 182 merge into return duct 183 back to an inlet of furnace housing 109. Heated duct gas is propelled through the ducting arrangement via supply fan 174 which drives gas heated by burner 170 into the furnace outlet. Burner 170 is supplied with a suitable fuel from a fuel source 107 coupled to burner 170 via a motorized valve assembly 171. Combustion air is supplied via filter 116 and fan 108 to burner 170.

A portion of the circulating heating gas is exhausted to outside atmosphere or to an exterior treatment facility via duct 183*a* which branches from return line 183 via motorized damper assembly 166 and combustion exhaust fan 165.

Fresh make-up convection gas, such as air, is furnished to oven 100 via a filter 115 at a fresh air intake and a make-up supply fan 110 and control damper 112 through a heat exchanger assembly 154, wherein the fresh make-up air is heated by a portion of the circulating heating gas supplied by furnace 109. This portion is determined by control damper 155 in a return conduit branching from furnace outlet duct 180. The fresh make-up convection gas is then injected into convection air supply plenum 122 via duct 140 such that the make-up convection heated gas is mixed with convection gas returning from heating chamber 114 by fan assemblies 111. In this embodiment, heat exchanger 154 is housed within furnace housing 109.

Oven quick-cool or purge cycles are provided via a fresh air or other gas inlet at filter 117 and duct 183*c* which branches into return duct 183 via motorized damper assembly 167.

At least one temperature sensor 150, such as a thermocouple, is positioned in either of the return plenums 184 or 185 and its output is coupled to a stored program control device 151 and a similar stored program device 172 at inputs thereof. Devices 151 and 172 may comprise commercially available programmable logic controllers. Alternatively, these control devices could comprise commercially available direct digital controllers (DDC) or microprocessor-based controllers, relay logic or pneumatic controllers. Additionally, devices 151 and 172 could be combined into a single controller.

One or more outputs of controller 151 are coupled to a plurality of variable frequency motor drive units for each fan assembly. As seen from FIG. 1, variable frequency drive units 152*a* and 152*b* are respectively coupled to the drive motors 153*a* and 153*b* of fan assemblies 111*a* and 111*b*, respectively. In any case, the output of controller 151 controls each drive motor of the plurality of fan assemblies provided for the oven via variable frequency drive units 152 (see units 152*a*, 152*c* and 152*d* of FIG. 2, for example).

Controller 172 may optionally have a second input coupled to a temperature sensor 173 positioned in output duct 180 for monitoring the temperature of the heated gas supplied to the radiation panel ducts 177 and 179. An output of controller 172 is coupled to the control motor of motorized valve assembly 171.

Variable frequency drive units 152*a–d* may, for example, comprise an ABB VFD variable torque motor drive, commercially available from ABB Industrial Systems, Inc., New Berlin, Wis.

Temperature sensor 150 may be positioned anywhere within oven 100 where it will accurately monitor the temperature of the returning convection gas without being falsely affected by the radiant heat emanating from radiant emitting surfaces 191*a–d* and 192*a–d*.

The operation of the baking oven 100 of FIGS. 1 and 2 may be summarized, as follows. Objects 103 to be baked are moved through drying chamber 114 via conveyor system 121 and passed beneath longitudinally extending convection air supply openings 135*a* and 135*b*. Convection air circulation is provided by centrifugal fan assemblies 111*a,b,c,d* mounted on and through oven roofs 127*a* and 127*b*.

Supply plenum 122 at the top of chamber 114 is defined by the space between oven inner roof 127*b* and ceiling 138. The centrifugal fan assemblies 111*a–d* pressurize supply plenum 122 which, in turn, directs convection air downwardly via splitter 122 as shown by phantom arrows 101 through longitudinally extending openings 135*a,b* and then further through chamber 114, again shown by phantom arrows 101. The convection air is then drawn through lower longitudinally extending openings 161*a* and 161*b* and is recirculated behind the longitudinally extending radiant emitter ducts 177*a,b,c,d* and 179*a,b,c,d* upwardly to the inlets of fan assemblies 111*a–d*. The lower return openings 161*a* and 161*b* can be optionally equipped with air filters (not shown) to clean the convection air before it is recirculated to the oven chamber 114.

The temperature of the objects 103 is controlled by varying the flow rate of the convection air in the oven, for example by controlling the speed of the fan assemblies. Alternatively, or in addition to varying convection air flow rate, the radiation duct heating air temperature may be varied to generate a desired temperature of object 103. The convection air temperature is sensed in return plenum 184 or 185 by temperature sensor 150.

Control device 151 receives an input signal from temperature sensor 150 and provides a proportional output signal to variable frequency drive devices 152*a,b,c,d* which, in turn, may vary the speed of respective fan assemblies 111*a,b,c,d* and/or burner control device 172 may be used to vary the amount of fuel supplied to burner 170 via motorized valve assembly 171. Alternatively, for example, the invention contemplates varying convection air flow rate via variable air inlets or outlets, such as motorized dampers, associated with fan assemblies 111. Such dampers could likewise be controlled in accordance with temperature sensed by sensor 150.

The temperatures of the emitting surfaces 191*a–d* and 192*a–d* are independently controlled by heated gas, such as air, flow through longitudinally extending ducts 177*a,b,c,d* and 179*a,b,c,d* which abut the radiant emitting surfaces 191*a–d* and 192*a–d*, respectively. The heated gas for conduits 177*a–d* and 179*a–d* is heated by a gas fired burner 170 controlled by motorized gas valve assembly 171, controller 172 and temperature sensor 173 mounted in furnace outlet duct 180. The heated gas is circulated via fan 174, supply duct 180, input manifolds 175 and 176, thence longitudinally through ducts 177*a–d* and 179*a–d*, respectively. The heated gas is then further circulated through return conduits 181 and 182 located at opposite longitudinal ends of the ducts.

Heated gas flow balance dampers 190*a–h* are provided at each junction between the longitudinal radiation heating ducts 177*a–d* and 179*a–d* and the return ducts 181 and 182. These dampers may be set up to provide different air flow rates and therefore different radiant heat transfer rates from top to bottom in chamber 114 provided by radiation emitting surfaces 191*a–d* and 192*a–d*.

The surface temperature profile of radiant emitting surfaces 191*a–d* and 192*a–d* may be further varied as one travels along the longitudinal axis of chamber 114 by varying the cross-sectional area of radiant emitter ducts 177*a–d* and 179*a–d*.

Baking oven 100 further incorporates the use of a dedicated combustion exhaust fan 165 to be used in conjunction with motorized damper 166 and motorized dampers 167. As an alternative to damper 166, exhaust flow could be varied using a controlled motor driver with a variable speed fan 165. During an oven purge cycle or quick cool cycle, motorized damper 166 moves to the full open position, while motorized dampers 167 operate to close off returning heated gas to a minimum and open fresh heating gas intake at filter 117 to a maximum. During normal operation of oven 100, motorized damper 166 closes to a minimum position to allow exhaust products of combustion while motorized dampers 167 operate to dose fresh air intake via filter 117 to minimum and return the oven to a recirculation mode.

Fresh make-up convection gas, such as air, is required by inlet filter 115 and supply conduit 140 to minimize solvent vapor and water vapor levels within oven chamber 114. This fresh make-up convection gas or air change is accomplished by exhausting a portion of the convection gas from the oven return plenums 184 or 185 via exhaust fan 120 and supplying fresh make-up convection gas through fresh gas supply fan 110 and conduit 140. The fresh convection gas temperature may be manually set up by an adjusting damper 155 which controls the flow of heating gas in heat exchanger 154.

Figure 3:
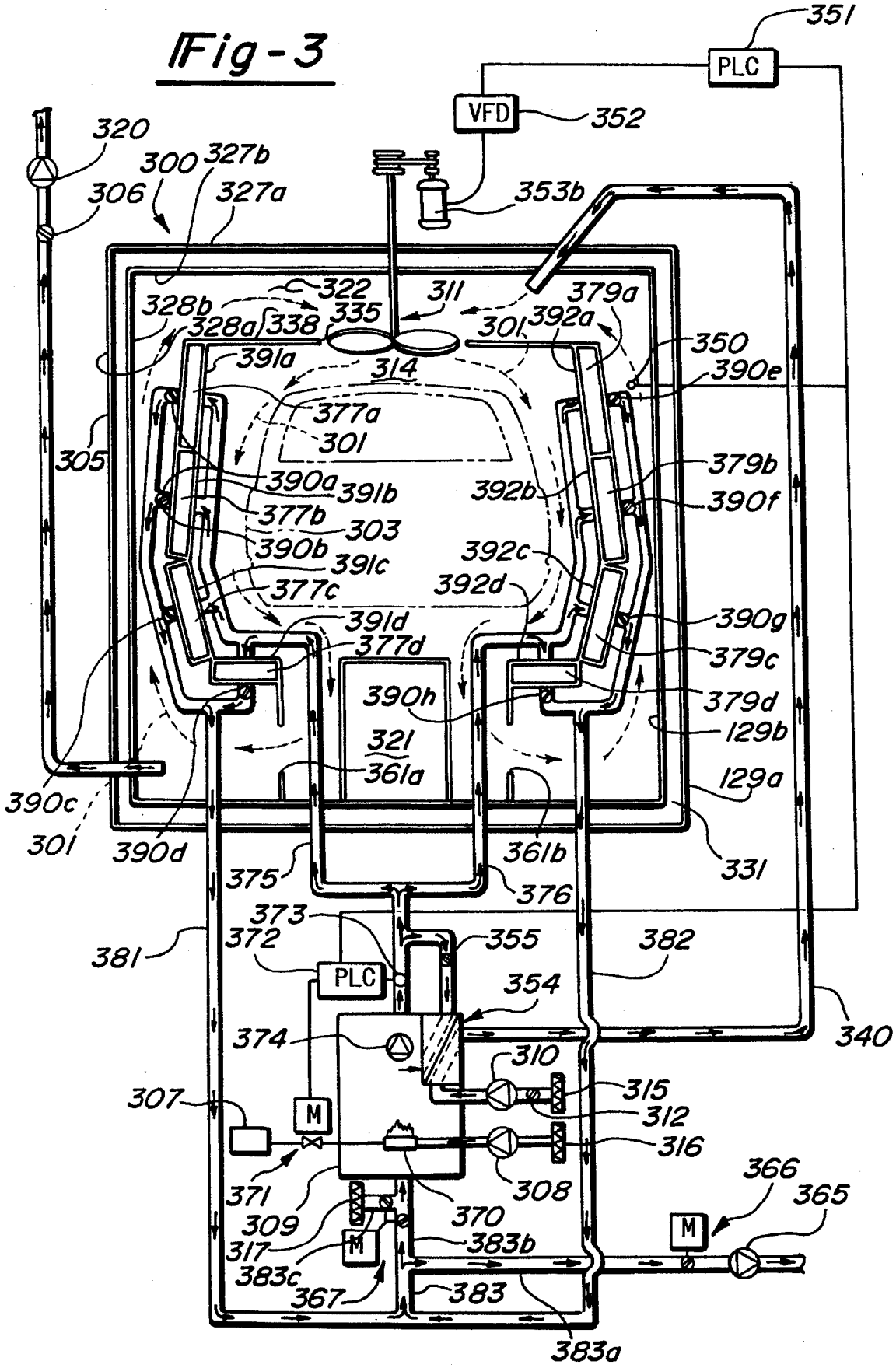
FIG. 3 is a cross-sectional view taken along the longitudinal axis of an alternative embodiment of a combined radiant and convection oven arranged in accordance with the principles of the invention.

An alternative arrangement of a paint baking oven arranged in accordance with the principles of the invention is set forth in the cross sectional view of FIG. 3. Oven 300 of FIG. 3 is substantially identical to the oven 100 of FIGS. 1 and 2, with the exception that the fan assemblies of oven 300, such as 311, are propeller type fans for directing air into baking chamber 314 of oven 300. Fan assemblies 311 would be substantially longitudinally aligned along a length of chamber 314 and mounted in openings directly above chamber 314 as shown. All other components of oven 300 are the same as those shown in the oven 100 of FIGS. 1 and 2. Similar components bear the same numerical designation except for the most significant digit thereof which, in FIG. 3, comprises a 3 rather than a 1. The operation of the oven of FIG. 3 is identical to that set forth above with reference to FIGS. 1 and 2 except that the convection gas or air is directed into chamber 314 via propeller fans 311 rather than centrifugal fan assemblies 111.

Figure 4:
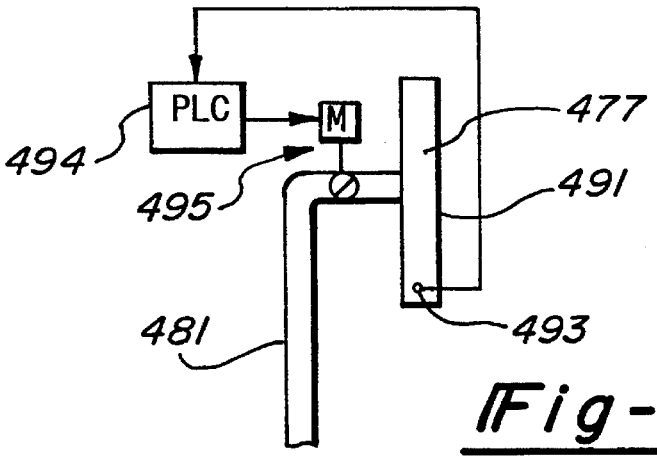
FIG. 4 is a schematic diagram of an alternative flow control damper arrangement for the heating ducts associated with the radiant heat emitting surfaces of the ovens of FIG. 1 and FIG. 3.

As a further alternative to establishing a predetermined temperature profile of the radiant heat emitting surfaces 191*a–d* and 192*a–d* of FIG. 1 or 391*a–d* and 392*a–d* of FIG. 3, the temperature of the heating gas in each longitudinally extending duct may be independently monitored and controlled at each duct by an arrangement such as that set forth in FIG. 4.

As seen from FIG. 4, each duct 491 would have a temperature sensor 493 coupled to an input of a stored program controller 494. An output of the controller 494 would then be coupled to the drive motor of a motorized damper assembly 495 located in an output duct emanating from one end of longitudinally extending duct 477. Such a duct is designated 481 in FIG. 4. In this manner, the flow rate of the heating gas in each duct could be independently monitored and varied via the arrangement shown.

As mentioned earlier, a desired temperature profile along the longitudinal length of each radiation emitting surface 191*a–d* and 192*a–d* of the oven of FIG. 1 or 391*a–d* and 392*a–d* of the oven of FIG. 3, can be obtained by varying the transverse cross sectional area of the duct as one proceeds along its longitudinal length.

One of the ducts 177*a* of FIG. 1 is set forth in more detail in the plan views of FIGS. 5A, 5B and 5C. Duct 177*a* carries or incorporates integrally radiant energy emitting surface 191*a* extending longitudinally along the heating chamber of the oven. Heating gas is introduced at an entrance end 195*a* and flows longitudinally through duct 177*a* to exit from an exit end 193*a*.

As seen from FIGS. 5B and 5C, the cross sectional area of duct 177*a*, as viewed substantially normal or perpendicular to a longitudinal axis of duct 177*a*, varies as one proceeds along such axis. Specifically, the cross sectional area is largest, in the example shown, at entrance end 195*a* and tapers to a smallest cross sectional area at exit end 193*a*.

The smaller the duct's cross section, the higher the heating gas velocity through the duct, and, in turn, the more heat that is transferred from the heating gas to the portion of radiating surface 191*a* abutting the narrower sections of duct 177*a*. Hence, for example, by decreasing the transverse duct cross section as one proceeds from an input end 195*a* for the heating gas to the duct's output end 193*a*, the loss of gas heat content available for transferral to surface 191*a* as the gas travels further from its heat source may be at least partially compensated by increasing the heating gas flow rate toward the duct's remote exit end 193*a* by decreasing the duct's cross sectional area as one proceeds in that direction.

The invention has been demonstrated by the use of preferred embodiments which are set forth for the sake of example. Equivalent alternative arrangements will become apparent to those skilled in the art in view of the above description. For example, the radiant heat emitting surfaces shown in the embodiments of FIG. 1 and FIG. 3 are substantially planar, but could be curved or arcuate. Any shape suitable for the application is contemplated by the invention. The invention is to be defined by the appropriately interpreted appended claims.

What is claimed is:

1. A combined radiant and convection heating oven for heating an object therein comprising:

a heating chamber extending along a longitudinal axis of the oven;

at least one motor-driven fan having an output in fluid communication with the heating chamber for delivering a convection gas to the chamber and having an input for receiving convection gas returning from the chamber;

at least one radiant heat emitting surface extending substantially parallel to the longitudinal axis and positioned within the heating chamber;

a duct carrying a heated gas and associated with the at least one radiant heat emitting surface for transferring heat thereto;

a source of the heated gas having an output coupled to the duct;

a temperature sensor positioned to monitor temperature of the convection gas returning from the chamber; and means coupled to the temperature sensor for varying a rate at which heat is transferred from the convection gas and the radiant heat emitting surface to the object while maintaining ambient temperature in the chamber substantially at a predetermined set point.

2. The combined radiant and convection heating oven of claim 1, wherein the means for varying comprises means coupled to the temperature sensor for varying flow volume of convection gas within the heating chamber in accordance with monitored returning convection gas temperature.

3. The combined radiant and convection heating oven of claim 2, wherein the means for varying flow volume comprises means for varying speed of the motor-driven fan.

4. The combined radiant and convection heating oven of claim 1, wherein the means for varying comprises means coupled to the temperature sensor for varying temperature of the heated gas delivered by the source of heated gas to the duct.

5. The combined radiant and convection oven of claim 1, wherein the means for varying comprises:

first means coupled to the temperature sensor for varying flow volume of convection gas within the heating chamber in accordance with monitored returning convection gas temperature, and second means coupled to the temperature sensor for varying temperature of the heated gas delivered by the source of heated gas to the duct.

6. The combined radiant and convection oven of claim 1 further comprising:

a source of heated convection gas having an output coupled in fluid communication with the at least one motor-driven fan for mixing the heated convection gas with the convection gas returning from the chamber.

7. The combined radiant and convection oven of claim 2 further comprising:

a source of heated convection gas having an output coupled in fluid communication with at least one motor-driven fan for mixing the heated convection gas with the convection gas returning from the chamber.

8. The combined radiant and convection oven of claim 3 further comprising:

a source of heated convection gas having an output coupled in fluid communication with the at least one motor-driven fan for mixing the heated convection gas with the convection gas returning from the chamber.

9. The combined radiant and convection oven of claim 4 further comprising:

a source of heated convection gas having an output coupled in fluid communication with the least one motor-driven fan for mixing the heated convection gas with the convection gas returning from the chamber.

10. The combined radiant and convection oven of claim 5 further comprising:

a source of heated convection gas having an output coupled in fluid communication with the at least one motor-driven fan for mixing the heated convection gas with the convection gas returning from the chamber.

11. The combined radiant and convection oven of claim 1, wherein the duct has a cross-section taken substantially normal to the longitudinal axis which varies in area at different locations in the duct along the axis.

12. The combined radiant and convection oven of claim 1, wherein the duct further comprises an adjustable damper for controlling heated gas volume flow rate through the duct.

13. The combined radiant and convection oven of claim 3, wherein the means for varying speed of the motor-driven fan comprises a stored program controller and a variable frequency motor driver, the stored program controller having an input coupled to the temperature sensor and an output coupled to an input of the variable frequency motor driver, and the variable frequency motor driver having an output coupled to the at least one motor-driven fan.

14. The combined radiant and convection oven of claim 4, wherein the means for varying temperature of the heated gas comprises a stored program controller and a motorized gas valve, the stored program controller having an input coupled to the temperature sensor and an output coupled to a control input of the motorized gas valve, the motorized gas valve being coupled between a source of burner fuel gas and a burner for heating the heated gas.

15. The combined radiant and convection oven of claim 14, wherein the means for varying temperature of the heated gas further comprises an additional temperature sensor positioned for monitoring temperature of the heated gas delivered to the duct, and an additional input of the stored program controller coupled to the additional temperature sensor.

16. A combined radiant and convection heating oven for heating an object therein comprising:

a heating chamber extending along a longitudinal axis of the oven;

a plurality of motor-driven fans, each having an output in fluid communication with the heating chamber for delivering a convection gas to the chamber and each having an input for receiving the convection gas returning from the chamber;

a plurality of radiant heat emitting surfaces each extending substantially parallel to the longitudinal axis and positioned within the heating chamber for directing radiant energy toward an object placed within the chamber;

a plurality of ducts, each carrying a heated gas and each associated with a respective one of the plurality of heat emitting surfaces for transferring heat thereto;

furnace means for supplying the heated gas to the ducts;

a temperature sensor to monitor temperature of the convection gas returning from the chamber; and means coupled to the temperature sensor for varying a rate at which heat is transferred from the convection gas and the radiant heat emitting surfaces to the object while maintaining ambient temperature in the chamber substantially at a predetermined set point.

17. The combined radiant and convection oven of claim 16, wherein the means for varying comprises means coupled to the temperature sensor for varying flow volume of convection gas within the heating chamber in accordance with monitored returning convection gas temperature.

18. The combined radiant and convection oven of claim 17, wherein the means for varying flow volume comprises means for varying speed of at least one of the plurality of motor-driven fans.

19. The combined radiant and convection oven of claim 16, wherein the means for varying comprises means coupled to the temperature sensor for varying temperature of the heated gas supplied by the furnace means.

20. The combined radiant and convection oven of claim 16, wherein the means for varying comprises:

first means coupled to the temperature sensor for varying flow volume of convection gas within the heating chamber in accordance with monitored returning convection gas temperature; and second means coupled to the temperature sensor for varying temperature of the heated gas supplied by the furnace means.

21. The combined radiant and convection oven of claim 16 further comprising:

a source of heated convection gas having an output coupled in fluid communication with at least one of the motor-driven fans for mixing the heated convection gas with the convection gas returning from the chamber.

22. The combined radiant and convection oven of claim 17 further comprising:

a source of heated convection gas having an output coupled in fluid communication with at least one of the motor-driven fans for mixing the heated convection gas with the convection gas returning from the chamber.

23. The combined radiant and convection oven of claim 18 further comprising:

a source of heated convection gas having an output coupled in fluid communication with at least one of the motor-driven fans for mixing the heated convection gas with the convection gas returning from the chamber.

24. The combined radiant and convection oven of claim 19 further comprising:

a source of heated convection gas having an output coupled in fluid communication with at least one of the motor-driven fans for mixing the heated convection gas with the convection gas returning from the chamber.

25. The combined radiant and convection oven of claim 20 further comprising:

a source of heated convection gas having an output coupled in fluid communication with at least one of the motor-driven fans for making the heated convection gas with the convection has returning from the chamber.

26. The combined radiant and convection oven of claim 16, wherein at least one of the plurality of ducts has a cross-section taken substantially normal to the longitudinal axis which varies in area at different locations in the at least one duct along the axis.

27. The combined radiant and convection oven of claim 16, wherein at least one of the plurality of ducts further comprises an adjustable damper for controlling heated gas volume flow rate through the at least one duct.

28. The combined radiant and convection oven of claim 18, wherein the means for varying speed of at least one of the plurality of motor-driven fans comprises a stored program controller and a variable frequency motor-driver, the stored program controller having an input coupled to the temperature sensor and an output coupled to an input of the variable frequency motor-driver, and the variable frequency motor-driver having an output coupled to the at least one motor-driven fan.

29. The combined radiant and convection oven of claim 19, wherein the means for varying temperature of the heated gas comprises a stored program controller and a motorized gas valve, the stored program controller having an input coupled to the temperature sensor and an output coupled to a control input of the motorized gas valve, the motorized gas valve being coupled to the furnace means for varying flow of fuel thereto.

30. The combined radiant and convection oven of claim 29, wherein the means for varying temperature of the heated gas further comprises an additional temperature sensor positioned for monitoring temperature of the heated gas at an output of the furnace means, and an additional input of the stored program controller coupled to the additional temperature sensor.

31. The combined radiant and convection oven of claim 16, wherein each of the plurality of ducts further comprises an adjustable damper for independently controlling heated gas volume flow rate through each one of the plurality of ducts.

32. The combined radiant and convection oven of claim 21, wherein the source of heated convection gas comprises:

a source of fresh convection gas coupled in heat exchanging relationship with heated gas supplied by the furnace means.

33. A heating oven comprising:

a heating tunnel having a top surface and a bottom surface extending along a longitudinal axis of the oven;

a plurality of heated gas carrying ducts each carrying a radiant heat emitting independently heated by its respective duct, each duct extending longitudinally along and within the tunnel such that at least two adjacent separate radiant heat emitting surfaces are positioned between the top surface and the bottom surface of the tunnel, each duct having a cross-section taken substantially normal to the longitudinal axis which varies in area at different locations in each duct along the axis.

34. A heating oven comprising:

a heating tunnel having a top surface and a bottom surface extending along a longitudinal axis of the oven;

a plurality of heated gas carrying ducts each carrying a radiant heat emitting independently heated by its respective duct, each duct extending longitudinally along and within the tunnel such that at least two adjacent, separate radiant heat emitting surfaces are positioned between the top surface and the bottom surface of the tunnel, each duct having adjustable damper means for independently controlling flow rate of heated gas through each duct.

35. The heating oven of claim 34, wherein each duct has a cross-section taken substantially normally to the longitudinal axis which varies in area at different locations in each duct along the axis.

* * * * *

UNITED STATES PATENT AND TRADEMARK OFFICE

CERTIFICATE OF CORRECTION

PATENT NO. : 5,588,830

DATED : December 31, 1996

INVENTOR(S) : Leif E.B. Josefsson et al.

It is certified that error appears in the above-identified patent and that said Letters Patent is hereby corrected as shown below:

Column 6, line 45, "dose" should be --close--.

Column 9, line 4, Claim 9, before "least" insert --at--.

Column 10, line 53, Claim 25, "has" should be --gas--.

Column 12, line 4, Claim 33, before "independently" insert --surface--.

Column 12, line 18, Claim 34, before "independently" insert --surface--.

Signed and Sealed this

Fifteenth Day of July, 1997

Bruce Lehman

*Attest:*

BRUCE LEHMAN

*Attesting Officer*

*Commissioner of Patents and Trademarks*